United States Patent [19]

Coleman

[11] 4,042,894

[45] Aug. 16, 1977

[54] MULTI-POLE CIRCUIT BREAKER SYSTEM WITH COMMON TRIP MEANS

[75] Inventor: Edward Coleman, Inkpen, England

[73] Assignee: Ottermill Limited, England

[21] Appl. No.: 605,137

[22] Filed: Aug. 15, 1975

[30] Foreign Application Priority Data

Sept. 20, 1974 United Kingdom ..... 41035/74

[51] Int. Cl.[2] ..... H01H 77/00

[52] U.S. Cl. ..... 335/9; 335/172; 337/43

[58] Field of Search ..... 335/9, 10, 35, 38, 172, 335/37; 337/43, 46, 48

[56] References Cited

U.S. PATENT DOCUMENTS

| | | | |
|---|---|---|---|
| 2,977,443 | 3/1961 | Middendorf | 337/43 |
| 2,977,444 | 3/1961 | Middendorf | 337/43 |
| 3,116,387 | 12/1963 | Middendorf | 337/43 |
| 3,193,646 | 7/1965 | Krebs et al. | 335/10 X |
| 3,486,150 | 12/1969 | Clark | 337/46 X |
| 3,760,308 | 9/1973 | Misencik | 337/46 X |
| 3,840,833 | 10/1974 | Mrenna et al. | 337/46 X |

*Primary Examiner*—George Harris
*Attorney, Agent, or Firm*—Robert E. Converse, Jr.

[57] ABSTRACT

A multi-pole circuit breaker system includes a plurality of individual circuit breakers and at least one tripping action transfer device disposed between adjacent circuit breakers. The tripping action transfer device includes a lever pivotally supported at one end and carrying a rod shaped transfer member at its other end. The transfer member extends into the interior of the housings of adjacent circuit breakers and cooperates with their tripping mechanisms. A tripping operation of one circuit breaker engages the transfer member and causes actuation of the tripping mechanism of the adjacent breaker to initiate simultaneous tripping thereof.

8 Claims, 4 Drawing Figures

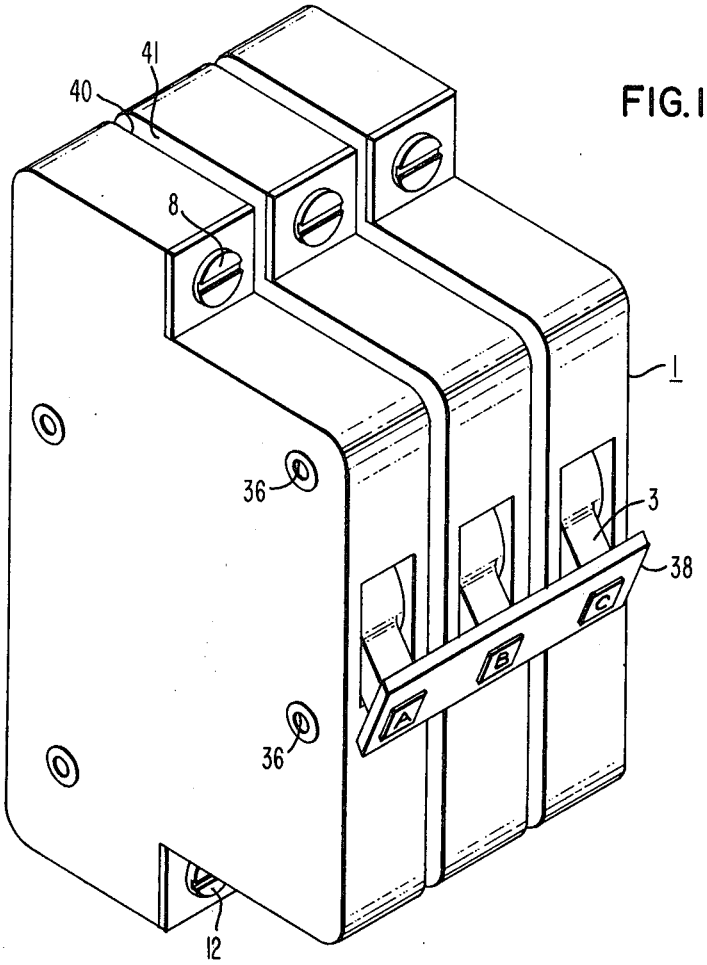
FIG. 1
FIG. 4
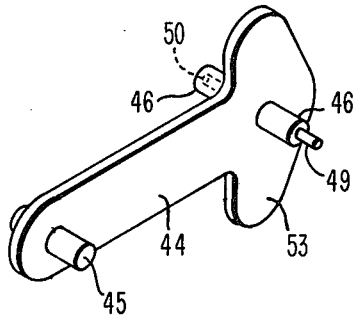

MULTI-POLE CIRCUIT BREAKER SYSTEM WITH COMMON TRIP MEANS

BACKGROUND OF THE INVENTION

1. Field of the Invention

The invention relates to multi-pole electric circuit breaker systems.

2. Description of the Prior Art

Electric circuit breakers have tripping means which cause tripping of the breaker for interruption of a circuit when a current flows through the breaker which is in excess of a predetermined threshold current. Such a threshold current may, for example, be between three and five times the rated normal operating current for the breaker. Sometimes, the requirement exists that the breaker will trip rapidly when the excess current conditions occur, for example within 0.2 seconds, but requirements sometimes exist for the breaker to withstand overload current for a longer time before tripping. The provision of given tripping characteristics requires careful design of the tripping means in the breaker and, particularly in space-saving designs, it is difficult to provide means for causing common tripping of all breakers of a group, when one of the breakers in the group is tripped.

One method of effecting common tripping is employed in the circuit breaker system described in U.S. Pat. No. 3,550,047 issued Dec. 22, 1970 to Francis L. Gelzheiser and assigned to the assignee of the present invention. A common trip member is rotatably mounted within the circuit breaker enclosure and includes slots at each end. A flat connecting member is keyed into the slots of the trip members of adjacent breakers to provide pivotal movement of the assembly along a common axis. It is desirable to provide an improved circuit breaker system which exhibits ease of assembly and a low degree of lost motion.

SUMMARY OF THE INVENTION

The invention consists in a multi-pole electric circuit breaker system comprising a plurality of individual circuit breaker mechanisms each having a switching arrangement which completes an electric circuit when the individual breaker is in a closed condition and which interrupts the circuit when the individual breaker is tripped, the switching arrangement having an actuating member which is held by a movably mounted latch member when the breaker is in the closed condition and which is released by the latch member for actuating the switching arrangement to an open condition when the breaker is tripped, tripping means being provided for moving the latch member, when a current in excess of a given threshold current flows, and thereby trip the breaker, the individual breakers being disposed in a spaced apart relationship with the space between each two adjacent breakers containing a tripping action transfer device having a transfer portion extending into each of said two adjacent breakers, the said transfer portions being so disposed that on tripping of one of the individual breakers by operation of the said tripping means, the said transfer portion extending into the said one breaker is actuated and causes the transfer portion extending into the other of said two adjacent breakers to operate the tripping means in said other breaker to cause simultaneous tripping thereof.

Two individual circuit breaker mechanisms may be provided, with one tripping action transfer device disposed between them, the transfer portions of the said one tripping action transfer device extending into the said two breakers.

Alternatively, at least three individual circuit breaker mechanisms may be provided, the transfer portions of the tripping action transfer devices being of rod-like form having mating formations at their ends whereby they form a common transfer bar extending into each outer breaker and through the inner breaker or breakers of the arrangement.

In one form, the tripping action transfer device, or each of them, comprises a lever having pivot stubs at one end region, which extend into pivot recesses in facing side walls of two adjacent breakers, and having the said transfer portions extending from its other end region, the transfer portions extending into the two adjacent breakers through slots in the said side walls. Preferably, the lever is obtained within a frame structure disposed between the said two side walls. The said other end region of the lever may be shaped to be engaged by the said structure in the manner of a limit stop, in at least one of the two end positions of movement of the transfer portions. The said other end region of the lever may be shaped so that in all positions of the lever it masks the slots in said facing side walls so as to substantially prevent the passage of ionized gas from one breaker to the next. Spring means may be provided for biasing the lever so that the transfer portions are normally disposed in one of the said end positions which corresponds to the breakers being in a non-tripped condition.

Advantageously, each breaker has an overcenter spring mechanism with an actuating cradle having an arm constituting said actuating member by which the switching arrangement is actuated on tripping of the breaker, the transfer portions of each tripping action transfer device being so disposed in relation to the said arm and the said latch member of the respective breaker, that on tripping of one breaker by movement of its latch member, the said arm of the one breaker engages and moves the respective transfer portion and the commonly moving other transfer portion of the same tripping action transfer device moves the latch member of the adjacent breaker to cause simultaneous tripping thereof.

Preferably, operating levers, by which all of the individual breakers are manually operable, are interconnected by ganging means, so that all of the breakers of the arrangement can be simultaneously switched or reset.

BRIEF DESCRIPTION OF THE DRAWINGS

In order to make the invention clearly understood, reference will now be made to the accompanying drawings which are given by way of example and in which:

FIG. 1 is a perspective view of a three-pole circuit breaker system;

FIG. 4 is a perspective view of the tripping action transfer device.

DESCRIPTION OF THE PREFERRED EMBODIMENTS

The circuit breaker system shown in FIG. 1 comprises three breakers A, B and C of identical construction, for common tripping of three electric circuits, for example three phases of a three phase circuit. The internal construction of one of the breakers will now be described with reference to FIG. 2.

Figure 2:
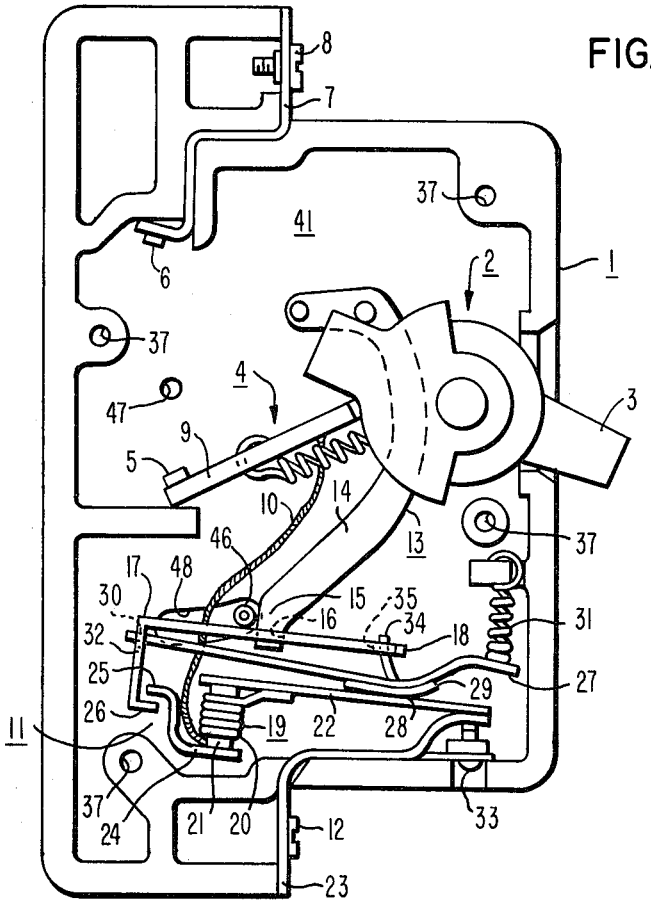
FIG. 2 is a diagrammatic sectional view through one of the breakers of the system of FIG. 1, with the mechanism shown in a partially reset condition.

The circuit breaker of FIG. 2 comprises a housing 1 of insulating material in which an overcenter spring mechanism 2 is provided which can be set by an operating lever 3 for operating a switching arrangement 4 so that a moving contact 5 can be brought into engagement with a fixed contact 6, or separated therefrom. The fixed contact 6 is connected by a metal strip 7 to a terminal 8 of the breaker and the movable contact 5 is connected by way of a contact carrying element 9 and a conductive metallic braid 10 and by way of a tripping arrangement 11, to a second terminal 12 of the circuit breaker.

The overcenter spring mechanism 2, and the switching arrangement 4, as well as the arrangement of the contacts 5 and 6 are conventional and will not be described in detail. Moveover, in view of the conventional nature of these portions of the circuit breaker, they have not been illustrated in detail, so as not to complicate the drawing.

The overcenter spring mechanism 2 comprises a cradle 13 which has an arm 14 which constitutes an actuating member by which the switching arrangement is actuated on tripping of the breaker. The actuating member 14 has a tapered end 15 which, when the breaker is in its closed condition, engages in an opening 16 in a latch member 17 which is pivoted to the housing 1 by means of lugs 18 on its end. The latch member 17 is of brass and the actuating member 14 of steel. This is a well known combination of materials for providing low friction and resistance to wear.

The tripping arrangement comprises an electromagnet 19 having a winding 20 and a core 21. The braid 10 is connected to one end of the winding 20 and the other end of the winding 20 is connected to a bimetallic member 22 which is fixed to a metal strip 23 which carries the second terminal 12 of the circuit breaker. The core 21 of the electromagnet is carried by an end of the bimetallic member 22 and the core also carries a bracket 24 which is cranked so as to have a portion 25 which can engage an upturned end portion 26 of the latch member 17 when the bimetallic member 22 has deflected by a certain extent on the passage therethrough of a sufficiently high current for a predetermined time.

It will be seen that when the bimetallic member 22 deflects the cranked portion 25 of the bracket 24 will engage the upturned end portion 26 of the latch member 17, thus moving the latch member 17 about the pivot lugs 18 so as to release the actuating member 14 of the overcenter spring mechanism. This tripping action caused by deflection of the bimetallic member 22 is complementary to a tripping action caused by the electromagnet which will now be described.

The electromagnet 19 has an armature 27 of steel or iron, which is pivotally mounted against the bimetal member 22 at a fulcrum region 28, a layer 29 of insulating material being interposed at the said fulcrum region. At one end, the armature 27 engages in a slot 30 in the latch member 17, and at its other end, the armature 27 is acted on by a compression spring 31 which biases the armature 27 into a position such that there is a gap between the said one end of the armature 27 and the wall of the slot 30, remote from the main portion of the latch member 17.

When an alternating electric current flows through the circuit breaker and thus also through the electromagnet 19, an alternating magnetic field is produced which influences the armature 27. The dimensions of the electromagnet 19 should be such that when the normal rated current of the circuit breaker flows, the alternating magnetic field is not sufficient to cause any appreciable movement of the armature 27. However, when a current flows which is of a magnitude such that tripping of the circuit breaker is desired, the alternating magnetic field is of sufficient strength to influence the armature 27 and cause a vibration thereof. Consequently, the said one end of the armature 27 will exert a series of vibratory impacts on the latch member 1 these impacts being applied to the latch member by striking of the armature 27 against the wall 32 of the slot 30. Actuation of the latch member 17 by means of these impacts is more reliable than direct actuation of a latch member which itself constitutes an armature of an electromagnet, as the repeated impacts overcome the friction between the latch member and the actuating member very effectively. If the frequency of the electric current flowing through the circuit breaker is 50 cycles per second, then in a time period of 0.2 seconds, the armature will exert 20 impacts on the latch member. Consequently, reliable tripping of the breaker within a time period of 0.2 seconds can easily be obtained. A screw 33 is provided for exerting an adjusting force on the upper end of the bimetallic member 22, whereby to control the position of the cranked portion 25 of the bracket 24 in relation to the portion 26 of the latch member 17. Also, it will be seen that the armature 27 has a guide lug 34 which extends into a slot 35 of the latch member 17, so as to assist in location of the armature 27.

The three individual breakers A, B and C of FIG. 1 are held together in a three-pole array by rivets 36 passing through holes 37 in the individual breakers (see also FIG. 2). The operating levers 3 of the three breakers are linked together by a ganging bridge 38 so that common switching and resetting of the three breakers is facilitated.

Figure 3:
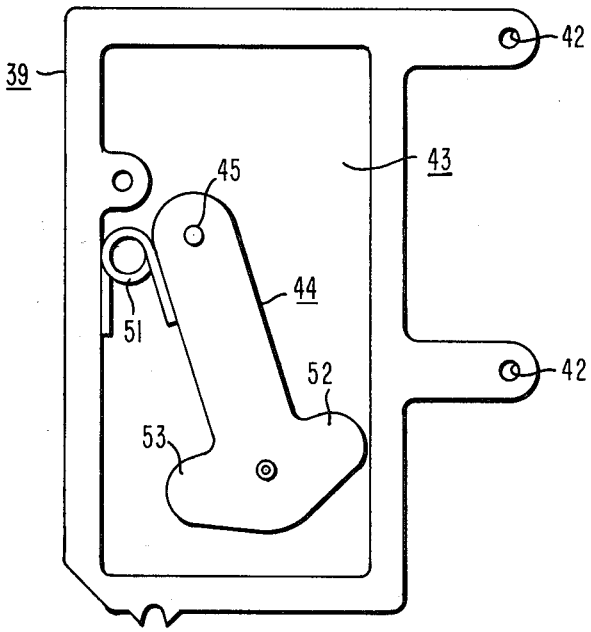
FIG. 3 is a view of a structure disposed in the spaces between the individual breakers of the system and enclosing a tripping action transfer device.

The three breakers A, B and C are arranged with their vertical center planes spaced apart by amounts determined by the nominal spacing between bus-bar lugs in a standard enclosure in which the breakers are intended to be housed; for example, a spacing of one inch. The breakers themselves are of a lesser thickness than the said center plane spacing, and the difference is made up by frame structures 39 disposed between facing side walls 40 and 41 of each two adjacent breakers. One such frame structure 39 is illustrated in FIG. 3. This structure is of electrically insulating material, for example molded nylon, and has holes 42 for the passage therethrough of the rivets 36.

Each frame structure 39 defines a generally rectangular space 43 in which is disposed a lever 44 (see also FIG. 4) having pivot stubs 45 at one end region, and rod-like transfer portions or members 46 at its other end region. The pivot stubs 45 are received in pivot holes 47 (see FIG. 2) in the facing side walls 40 and 41, and the transfer portions 46 extend into the two breakers in question, through slots 48 (see FIG. 2) in the facing side walls 40 and 41.

One of the transfer portions 46 of each lever 44 has a spigot end 49 and the other transfer portion 46 has a socket formation 50 at its end. By means of the spigot and socket formations, all of the levers 44 (two in the case of a three-pole arrangement) are interlinked, with all of the portions 46 forming a common tripping bar extending into the two endmost breakers and through the breaker (or breakers) disposed therebetween.

Since the transfer portions 46 of adjacent levers 44 are pivotally connected, it is not necessary to align the transfer portion 46 in a precise angular relationship about their common axis prior to interlocking them during assembly. Axial alignment is all that is required. An additional advantage is obtained by providing a single interface between transfer portions 46 of adjacent levers 44 through the spigot and socket joint instead of two interfaces with a connecting member. In this manner a lesser degree of lost motion is obtained.

Each lever 44, with its transfer portions 46, forms a tripping action transfer device, so that when any one breaker is tripped the tripping action is transferred to the adjacent breaker, whereby all breakers of the arrangement are simultaneously tripped.

It is clear from the discussion of FIG. 2, that a breaker is tripped by its tripping arrangement 11 causing the latch member 17 to move and thereby release the tapered end 15 of the arm 14, whereupon the arm 14 swings downwardly and operates the overcenter spring mechanism 2.

During an early part of this swinging movement, the arm 14 encounters the transfer portion 46 extending into the breaker through the slot 48 and urges this transfer portion 46 downwards. This causes the respective lever 44 to swing about the axis of the pivot stubs 45 against the action of a spring 51 which is mounted on the frame structure 39, or which in a modified arrangement is formed as a resilient integrally molded "tail" on the lever 44. The possible movement of the lever 44 in the upward direction is defined by an abutment lug 52 on the lever, which cooperates with the interior of the frame structure 39. A lug 53 provided on the lever 44 may also be arranged to cooperate with the interior of the frame structure 39 to define the possible movement of the lever 44 in the downward direction. Normally, however, the lower ends of the slots 48 will act as limit stops for the levers 44. The lugs 52 and 53 are of such a size that the slots 48 are masked in all positions of the levers 44. Thus, the lugs 52 and 53 of the levers 44 form barriers which prevent the passage of ionized gas from one breaker to the next, and thus prevent flashover effects between the poles of the multi-pole breaker arrangement.

Movement of the lever 44 as a result of tripping of one breaker causes the other transfer portion 46 of the same lever to correspondingly move, and engage the latch member 17 of the adjacent breaker to cause simultaneous tripping thereof.

It will be appreciated that any number of breakers may be grouped for common tripping in the above-described manner, since the transfer portions 46 of all of the levers 44, with one lever 44 being disposed between each two breakers, are linked together by their formations 49 and 50, thus forming in effect a common tripping bar extending through all of the breakers, the bar being actuated by tripping of one breaker and itself causing common tripping of all of the other breakers simultaneous with tripping of the said one breaker.

Also, it will be appreciated that, apart from the portions 46 which extend into the breakers, the tripping action transfer devices are disposed outside the individual breakers and consequently the invention is readily applicable to multi-pole breaker arrangements built up from existing single pole breaker designs, the individual breakers requiring modification only to the extent of provision of the slots 48 and the pivot holes 47.

If desired, the levers 44 may be pivoted on suitable formations provided on the frame structures 39, or, instead of being pivoted, may be connected to the structures 39 by resiliently flexible connecting means. In this latter case each lever may be integrally formed with the said frame structure, the resiliently flexible connecting means being formed by a reduced thickness portion of the material.

I claim:

1. A device as for effecting simultaneous tripping operation of adjacently mounted circuit breakers, comprising:

a frame structure disposed between the housings of said circuit breakers;

a lever contained within said frame structure and adapted for pivotal mounting at one end to said circuit breaker housings; and a transfer member supported at the other end of said lever and extending into the interior of said circuit breaker housings, said transfer member comprising a spigot at one end thereof and a socket at the other end thereof, said spigot and socket adapted to cooperate with corresponding spigots and sockets of transfer members of other of said devices to form spigot joints therewith;

said transfer member engaging the mechanism of said circuit breakers so that a tripping operation of one of said circuit breakers operates said transfer member to pivot said lever and operate the mechanism of said other circuit breakers to effect simultaneous tripping thereof.

2. A device for effecting simultaneous tripping operations of adjacently mounted circuit breakers, comprising a transfer member movably supported external to the housings of said circuit breakers and adapted for translational movement between first and second positions corresponding to tripped and untripped conditions of said circuit breakers, said transfer member extending into the housings of said circuit breakers and engaging the mechanisms thereof, said transfer member comprising receiving means at one end thereof and engaging means at the other end thereof, said receiving means cooperating with the engaging means of the transfer member of a second of said devices to permit rotation of said transfer members relative to each other, a tripping operation of one of said circuit breakers causing translational movement of said transfer member to actuate the mechanism of the other of said circuit breakers to effect simultaneous tripping thereof.

3. A device as recited in claim 2 wherein said transfer member comprises a rod, said engaging means comprises a spigot, and said receiving means comprises a socket.

4. A device for effecting simultaneous tripping operations of adjacently mounted circuit breakers comprising a transfer member and a lever, said lever being movably supported at one end external to the housings of said circuit breakers and adapted for translational movement between first and second position corresponding to tripped and untripped conditions of said circuit breakers, said transfer member being attached at the other end of said lever and extending into the housings of said circuit breakers and engaging the mechanisms thereof, a tripping operation of one of said circuit breakers causing translational movement of said transfer member to actuate the mechanism of the other of said circuit breakers to effect simultaneous tripping thereof, said device comprising a frame structure disposed between the housings of adjacent circuit breakers and containing said lever.

5. A device as recited in claim 4 wherein said frame structure cooperates with said other end of said lever to form a limit stop to locate at least one of said lever positions.

6. A multi-pole circuit breaker system, comprising :

a plurality of individual circuit breakers disposed in a spaced apart relationship, each of said individual circuit breakers comprising a housing having a pair of side walls, and a circuit breaker mechanism supported within said housing, each of said circuit breaker mechanisms comprising separable contacts operable between tripped and non-tripped positions to interrupt and complete an electrical circuit, a releasable actuating member operable upon release to actuate said contacts to interrupt an electrical circuit, a movably mounted latch member constraining said actuating member, and tripping means operable upon overcurrent conditions through said contacts to move said latch member thereby releasing said actuating member to actuate said contacts and interrupt an electrical circuit; and at least one tripping action transfer device, one of said tripping action transfer devices being positioned in each space between adjacent individual circuit breakers, each of said tripping action transfer devices comprising a transfer portion extending into the housing of each of said adjacent individual circuit breakers and cooperating with the circuit breaker mechanisms of said adjacent circuit breakers so that a tripping operation of one of said adjacent circuit breakers will cause said transfer portion extending into the other of said adjacent circuit breakers to operate the circuit breaker mechanism of said other adjacent circuit breaker to cause simultaneous tripping thereof, each of said tripping action transfer devices comprising a lever having pivot stubs at one end region, said pivot stubs extending into pivot recesses in said side walls of two adjacent circuit breakers, said lever having said transfer portions extending from the other end region of said lever, the transfer portions extending into the two adjacent circuit breakers through slots in said adjacent circuit breaker side wall;

said tripping action transfer device also comprising a frame structure disposed between said adjacent circuit breaker side walls and containing said lever within said frame structure.

7. A multi-pole circuit breaker system as claimed in claim 6, wherein said other end region of said lever is shaped to be engaged by said structure in the manner of a limit stop in at least one of the two end positions of movement of said transfer portions.

8. A multi-pole circuit breaker system, comprising:

a plurality of individual circuit breakers disposed in a spaced apart relationship, each of said individual circuit breakers comprising a housing having a pair of side walls, and a circuit breaker mechanism supported within said housing, each of said circuit breaker mechanisms comprising separable contacts operable between tripped and non-tripped positions to interrupt and complete an electrical circuit, a releasable actuating member operable upon release to actuate said contacts to interrupt an electrical circuit, a movable mounted latch member constraining said actuating member, and tripping means operable upon overcurrent conditions through said contacts to move said latch member thereby releasing said actuating member to actuate said contacts and interrupt an electrical circuit; and at least one device for effecting simultaneous tripping operation of adjacently mounted circuit breakers, comprising a frame structure disposed between the housings of said circuit breakers a lever contained within said frame structure and adapted for pivotal mounting at one end to said circuit breaker housings, and a transfer member supported at the other end of said lever and extending into the interior of said circuit breaker housings, said transfer member comprising a spigot at one end thereof and a socket at the other end thereof, said spigot and socket adapted to cooperate with corresponding spigots and sockets of transfer members of other of said devices to form spigot joints therewith; said transfer member engaging the mechanism of said circuit breakers so that a tripping operation of one of said circuit breakers operates said transfer member to pivot said lever and operate the mechanism of said other circuit breakers to effect simultaneous tripping thereof.

* * * * *